US011564031B2

(12) United States Patent
Peeters

(10) Patent No.: US 11,564,031 B2
(45) Date of Patent: Jan. 24, 2023

(54) EARPHONE BODY WITH TUNED VENTS

(71) Applicant: Tymphany Acoustic Technology Limited, Taipei (TW)

(72) Inventor: Thomas Pieter J. Peeters, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 17/342,823

(22) Filed: Jun. 9, 2021

(65) Prior Publication Data

US 2021/0392430 A1 Dec. 16, 2021

Related U.S. Application Data

(60) Provisional application No. 63/038,247, filed on Jun. 12, 2020.

(51) Int. Cl.
*H04R 1/10* (2006.01)
*H04R 1/28* (2006.01)

(52) U.S. Cl.
CPC ..... *H04R 1/2823* (2013.01); *H04R 1/1058* (2013.01)

(58) Field of Classification Search
CPC ..... H04R 1/10
USPC ..... 381/74
See application file for complete search history.

(56) References Cited

U.S. PATENT DOCUMENTS

2016/0295315 A1* 10/2016 Kuwahara ..... H04R 1/2849
2017/0223443 A1* 8/2017 Silvestri ..... H04R 1/1016

* cited by examiner

*Primary Examiner* — George C Monikang
(74) *Attorney, Agent, or Firm* — Muncy, Geissler, Olds & Lowe, P.C.

(57) ABSTRACT

An earphone body includes an internal chamber, a transducer housed in the internal chamber, a first tuned vent and a second tuned vent. The transducer has a front surface facing a direction of insertion of the earphone body in use and a rear surface 6B. The internal chamber provides a proximal acoustic volume adjacent the front surface of the transducer and a distal acoustic volume adjacent the rear surface of the transducer. The first tuned vent and the second tuned vent each extend between the distal acoustic volume and the ambient environment and are adapted to provide fluid communication between the distal acoustic volume and the ambient environment. The first tuned vent is tuned to a first frequency and the second tuned vent is tuned to a second frequency, the first frequency being lower than the second frequency.

11 Claims, 4 Drawing Sheets

EARPHONE BODY WITH TUNED VENTS

CROSS REFERENCE TO RELATED APPLICATIONS

The present application claims priority to U.S. Provisional Application No. 63/038,247, filed Jun. 12, 2020, the entire contents of which are hereby incorporated by reference.

FIELD OF THE INVENTION

The present disclosure relates to an earphone body with tuned vents. The present invention is applicable to both intra-canal and intra-concha earphones.

BACKGROUND OF THE INVENTION

Earphones typically come in two forms: sealed and leaky. Sealed earphones are intra-canal earphones. They are typically designed with a tip portion that fits snugly within the user's ear canal, essentially sealing off the cavity formed within the canal. Thus, sound output is maximized directly into the ear canal and lower frequencies of sound can be heard. However, other sounds are amplified also, such as external vibrations, and these reduce the quality of the sound for the user. Another disadvantage that may occur in these types of earphones is that the air pressure increases inside the ear canal when the tip portion of the earphone is inserted into the ear. This high air pressure may cause damage to the transducer membrane, discomfort and damage to the eardrum of the user, especially at higher sound pressure levels, and further decrease the quality of the sound.

Leaky earphones may be intra-canal or intra-concha. The intra-canal earphones have a similar design to the sealed earphone but they are provided with vents towards the innermost end of the earphone (in use) to reduce air pressure inside the earphone and the ear canal. The intra-concha earphones fit the outer part of the ear, resting just above the ear canal. Since these earphones do not seal with the ear canal, sound waves can leak uncontrollably from the earphones and also diminish the sound quality. Furthermore, acoustic quality performance is inconsistent between users due to variations in ear shapes and sizes.

SUMMARY OF THE INVENTION

The present invention seeks to provide an improved earphone body for providing optimized and finely-tuned adjustment of sound pressure levels in use over distinct frequency ranges, while simplifying the configuration of the earphone body and reducing associated manufacturing costs.

According to a first aspect of the present invention, there is provided an earphone body comprising an internal chamber, a transducer which is housed in the internal chamber, a first tuned vent and a second tuned vent, wherein:

the transducer has a front surface and a rear surface, the front surface facing in the direction of insertion of the earphone body in use, the internal chamber provides a proximal acoustic volume adjacent the front surface of the transducer, the internal chamber provides a distal acoustic volume adjacent the rear surface of the transducer, the first tuned vent and the second tuned vent each extend between the distal acoustic volume of the internal chamber and the ambient environment and are adapted to provide fluid communication between the distal acoustic volume and the ambient environment, and the first tuned vent is tuned to a first frequency or range of frequencies and the second tuned vent is tuned to a second frequency or range of frequencies, the first frequency or range of frequencies being lower than the second frequency or range of frequencies.

The present invention, therefore, relates to the acoustic architecture of an earphone where the proximal acoustic volume of the earphone body is adapted to be acoustically coupled to the ear entrance of the user. The term earphone, used herein and throughout the present application, is meant to refer to any in-ear audio device, whether intra-canal or intra-concha.

In accordance with the present invention, sound waves from the transducer cause sound pressure in the proximal and distal acoustic volumes of the earphone body. The first tuned vent and the second tuned vent are each in fluid communication with the distal acoustic volume of the internal chamber and the ambient environment. The first tuned vent and the second tuned vent, therefore, allow the transmission of sound waves from the distal acoustic volume to the ambient environment. The presence of the tuned vents means that it is easier for the transducer to move air in the internal chamber and this results in better sound quality particularly at lower frequencies where the transducer may move a relatively large volume of air as it generates sound waves. There may be an overlap in the frequency ranges that the tuned vents have an effect on.

The invention is not limited to the presence of two tuned vents and other vents may be provided either extending between the distal acoustic volume of the internal chamber and the ambient environment or between the proximal acoustic volume of the internal chamber and the ambient environment, which may be the ear canal of a user.

Each vent may be tuned by selecting an appropriate cross-sectional area and length for the vent. This affects the rate of air flow during operation of the transducer and this affects the acoustic response.

Each vent may extend substantially in a single direction (e.g., when the vent is straight) or it may have one or more changes of direction (e.g., when the vent has a bent section or has bent sections). The first tuned vent and/or the second tuned vent may have a tubular shape which preferably has at least one bent section along the length of the vent.

The first tuned vent has at least one dimension (e.g., length, width) which is different to at least one dimension of the second tuned vent. If other tuned vents are provided, extending between the distal acoustic volume of the internal chamber and the ambient environment, they may have one or more dimensions, which are the same as or different to the dimensions of the first and/or second tuned vents.

The actual dimensions of each vent are dictated in part by the size of the earphone body and, in particular by, the distal acoustic volume of the internal chamber of the earphone body.

The first tuned vent may have a lower width to length ratio than that of the second tuned vent.

The first tuned vent may have a lower cross-sectional area to length ratio than that of the second tuned vent.

The first tuned vent provides an acoustic volume, which is preferably different to the acoustic volume provided by the second tuned vent. If other tuned vents are provided, extending between the distal acoustic volume of the internal chamber and the ambient environment, they may each provide an acoustic volume, which is the same as or different to the acoustic volume of the first and/or the second tuned vents.

Preferably the first tuned vent and the second tuned vent have different cross-sectional areas in a direction perpendicular to each of their lengths: the lengths of these vents may be the same or different, with different lengths being preferred. It is also envisaged that the first tuned vent and the second tuned vent may have the same cross-sectional area but different lengths.

The cross-sectional area of each vent is preferably uniform along the length of the vent, but this is not essential.

In one embodiment, at least one vent is substantially circular in cross-section in a direction perpendicular to its length. When the first tuned vent and the second tuned vent are both circular in cross-section in a direction perpendicular to their length, the first tuned vent has a diameter, which is preferably different to the diameter of the second tuned vent.

The presence of the first tuned vent and the second tuned vent assists in controlling the pressure sound level over distinct frequency ranges for the user.

Preferably, the first tuned vent is tuned to a low frequency or to a range of low frequencies and the second tuned vent is tuned either to a low frequency or to a range of low frequencies or to a middle frequency or to a range of middle frequencies. In one embodiment, the first tuned vent is tuned to a distinctly lower frequency or frequency range than the second tuned vent.

The vents are present to modify the frequency response of the earphone by tuning the frequency response. The first tuned vent and the second tuned vent are preferably calibrated to achieve a desired acoustic response such as improving the bass response.

Generally-speaking, the greater the acoustic volume of a tuned vent in accordance with the present invention, the smaller the acoustic resistance within the distal acoustic volume, which increases the acoustic response.

By designing each tuned vent to predetermined dimensions, a corresponding acoustic mass results. The acoustic mass is the effect of the movement of sound waves on the mass of air in the vent and is dependent on the cross-sectional area of the vent in a direction perpendicular to its length, the length of the vent and the density of the air in the vent.

A combination of the acoustic mass and the distal acoustic volume of the internal chamber acts as a Helmholtz resonator at specific frequencies. This combination of the acoustic mass and the distal acoustic volume may be designed to amplify lower frequency sounds and/or to control the sound pressure level for a user.

The frequency or range of frequencies to which each vent is tuned is a tuning frequency or a range of tuning frequencies and a tuning frequency refers to the dip in frequency response generated by the vent due to the Helmholtz resonance generated in conjunction with the distal acoustic volume of the internal chamber.

The following formula relates to the resonant frequency of a resonator comprising a single vent (sound emission hole), which is circular in cross-section and an acoustic volume (volume of resonance chamber), which in the case of the present invention is the distal acoustic volume of the internal chamber of the earphone body.

$$fv = \frac{CD}{4}\sqrt{\frac{1}{\pi V(L+0.75D)}}$$

Where: fv is the resonant frequency of the resonator (Hz); V is the volume of the resonance chamber ($mm^3$); D is the diameter of the sound emission hole (mm); L is the depth of the sound emission hole (mm); and C is the speed of sound=approx. 344000 (mm/sec).

Assuming the volume of the resonance chamber is fixed, the relevant parameters are the cross-sectional area of the vent and the length of the vent. For vents which are circular in cross-section, the cross-sectional area is defined by the diameter, in accordance with this formula. A vent which is not circular in cross-section but has the same cross-sectional area as a vent of the same length that is circular in cross-section will have substantially identical system resonant frequency, assuming the same distal acoustic volume applies, such that this formula is a good approximation for vents which are not circular in cross-section. For example, the tuned vents may have an oval or polygonal shape (e.g., rectangular, pentagonal, hexagonal) in cross-section. The cross-sectional shape of the first tuned vent may differ from that of the second tuned vent.

In accordance with the present invention, the provision of two vents, tuned to different frequencies, and balancing the acoustic resistance present in these vents allows for finer control over the shape of the frequency response.

The first tuned vent is preferably tuned to a frequency or range of frequencies which is significantly lower than the frequency or range of frequencies of the second tuned vent, for example by an order of two.

By controlling additional acoustic resistances in the system, the relative contribution of the tuned vents to the overall frequency response allows tuning of the system frequency response.

In one embodiment, the sound pressure level is enhanced or reduced by providing an amount of acoustic resistance for the first tuned vent and/or the second tuned vent. Preferably, one or more acoustic resistance means are provided in series with the acoustic mass of the or each tuned vent. These acoustic resistances may be in the form of woven mesh having an acoustic resistance value. The sound pressure level may be enhanced or reduced over predetermined frequency ranges by the use of acoustic resistance means.

The first and/or second tuned vents of the present invention may be positioned to substantially oppose the rear surface of the transducer.

In one embodiment, the first and/or second tuned vents are located in a rear section of the earphone body, for example in a rear wall of the earphone body.

The location of each tuned vent is of relatively low importance, assuming the openings of the vents are not blocked or too close to other components inside the internal chamber of the earphone body. This is due to the fact that the wavelengths in question are significantly larger than the dimensions of typical earphones.

A front section (e.g., a front wall) of the earphone body is provided with at least one acoustic opening for allowing sound to exit the proximal acoustic volume to be received by a user's ear. This acoustic opening may substantially oppose the front surface of the transducer.

According to a second aspect of the present invention, there is provided an earphone comprising the earphone body of the present invention. The earphone may be configured to communicate with other devices such as smart phones, tablets or laptops. This communication may be wireless or via cables.

According to a third aspect of the present invention, there is provided a method of adjusting sound pressure levels output from an earphone to a user's ear using the earphone body of the present invention, the method comprising: sending an electrical signal to the transducer to produce sound waves in the proximal and distal acoustic volumes in the internal chamber of the earphone body; outputting the sound waves to be received by a user's ear (ie from at least the proximal acoustic volume); and transmitting sound waves from the distal acoustic volume to the ambient environment through the first tuned vent and the second tuned vent.

Non-limiting embodiments of the invention will now be described, by way of example only, with reference to the accompanying diagrammatic drawings.

DETAILED DESCRIPTION

Figure 1:
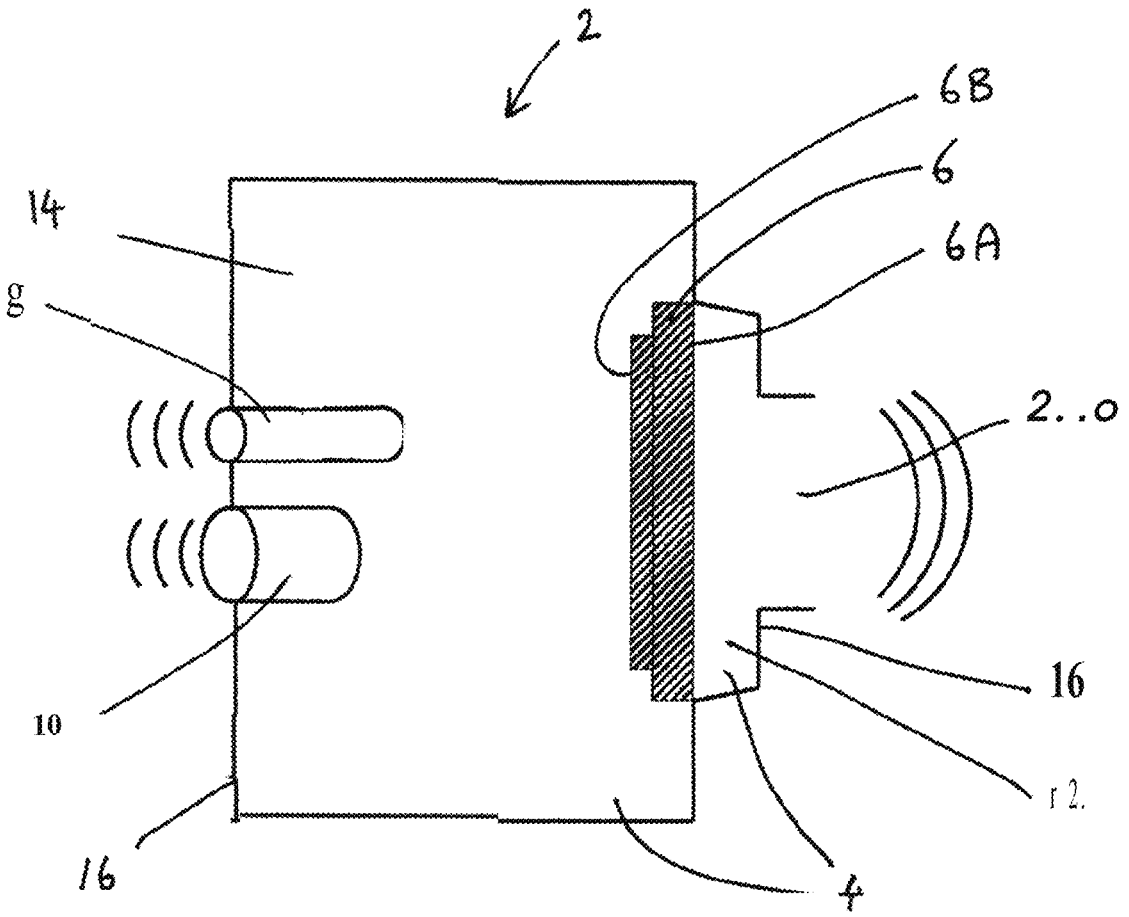
FIG. 1 is a schematic diagram of an earphone body according to an embodiment of the present invention.

With reference to FIG. 1, an earphone body 2 comprises an internal chamber 4, a transducer 6, which is housed in the internal chamber 4, a first tuned vent 8 and a second tuned vent 10. The earphone body may be used for leaky type or sealed type earphones. The earphones may be intra-canal or intra-concha, as appropriate.

The transducer 6 has a front surface 6A and a rear surface 6B. The front surface faces in the direction of insertion of the earphone body 2 into the entrance of a user's ear, in use of the earphone. The transducer 6 may be any type suitable for use within an earphone and is typically a driver (e.g., a speaker for receiving electrical signals). The transducer 6 is coupled to and operated by one or more electronic devices (not shown).

The internal chamber 4 provides a proximal acoustic volume 12 adjacent the front surface 6A of the transducer 6. The internal chamber 4 also provides a distal acoustic volume 14 adjacent the rear surface 6B of the transducer 6.

The first tuned vent 8 and the second tuned vent 10 each extend between the distal acoustic volume 14 of the internal chamber 4 and the ambient environment and are adapted to provide fluid communication between the distal acoustic volume 14 and the ambient environment.

In this embodiment, the first tuned vent 8 and the second tuned vent 10 are located in a rear section 16 (e.g., a rear wall) of the earphone body 3, substantially opposing the rear surface 6B of the transducer 6 in this example. A front section 18 (e.g., a front wall) of the earphone body 2 is provided with a primary acoustic opening 20 for allowing sound to exit the proximal acoustic volume 12 for direction into a user's ear canal. This primary acoustic opening 20 substantially opposes the front surface 6A of the transducer 6 in this example.

The earphone body 2 may be either the external casing of an earphone or a separate component within an earphone. The earphone body is adapted to receive digital or analog sound data for outputting sound to a user. The earphone body 2 may be formed of a rigid material (e.g., plastic). The internal cavity 4 houses internal components such as the transducer 6 and the earphone body 2 is designed to protect the internal components from damage.

Figure 2:
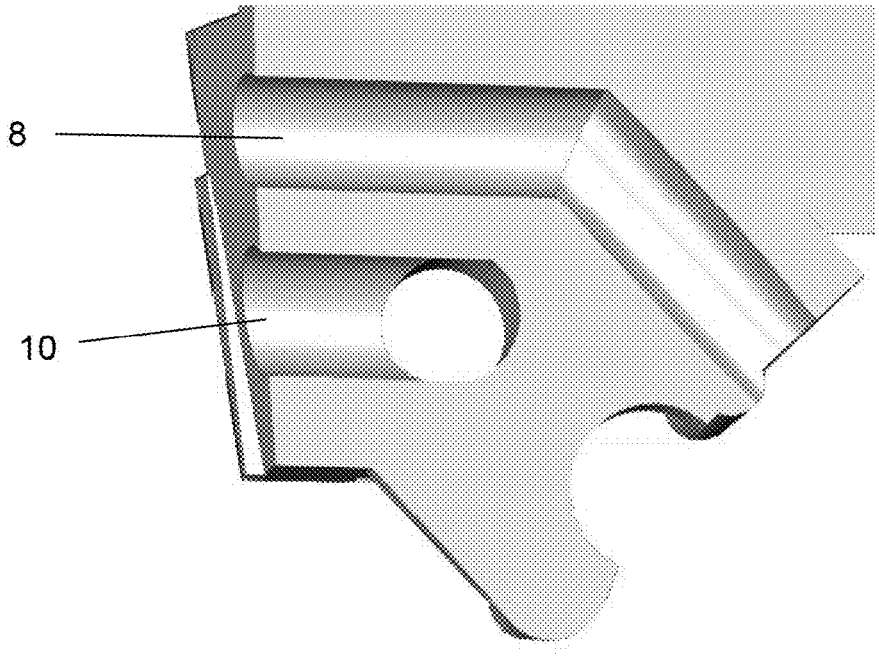
FIG. 2 is a perspective view of the top of a portion of an earphone body with a section cut away to show cross-sections of a first tuned vent and a second tuned vent in the direction of their length.

Referring to FIGS. 1 and 2, the first tuned vent 8 and the second tuned vent 10 are circular in cross-section in a direction perpendicular to the length of each vent. Alternatively, the first tuned vent 8 and the second tuned vent 10 may have a non-circular cross-sectional shape in a direction perpendicular to their lengths. For example, the tuned vents may have an oval or polygonal shape (e.g., rectangular, pentagonal, hexagonal) in cross-section. Also, the cross-sectional shape of the first tuned vent 8 in a direction perpendicular to its length may be different to the cross-sectional shape of the second tuned 10 vent in a direction perpendicular to its length.

Each vent of this embodiment is tuned by selecting an appropriate length and diameter (and therefore cross-sectional area) for the vent. Referring to FIG. 2, first tuned vent 8 consists of two straight sections along its length that meet at an angle of between 100 to 150 degrees. The second tuned vent 10 also consists of two straight sections along its length that meet at an angle of approximately 90 degrees. However, one or both tuned vents may instead consist of a single straight section or may consist of three or more straight sections. Alternatively, one or both tuned vents may consist of one or more curved and/or straight sections. The sections of each vent are in fluid communication with each other.

The length and diameter of the first tuned vent 8 are different to the length and diameter of the second tuned vent 10 in the present embodiment.

Each vent is tuned for a specific frequency response by selecting, in particular, an appropriate cross-sectional area and length for the vent. The dimensions of the first tuned vent and the second tuned vent are calibrated to provide distinct frequency responses, with the first tuned vent 8 being tuned to a lower frequency or range of frequencies than the second tuned vent 10.

The ratio of cross-sectional area to length defines the tuning frequency, given a fixed distal volume. A smaller ratio will result in a vent tuned to lower frequencies.

Referring to FIGS. 1 and 2, the second tuned vent 10 has a greater cross-sectional area and a shorter length than the first tuned vent 9. The first tuned vent 8, therefore, has a lower ratio of diameter to length than the second tuned vent, together with a lower ratio of cross-sectional area to length than the second tuned vent 10.

The first tuned vent 8 may be tuned to a low frequency or to a low frequency range, for example frequencies between 50 Hz and 800 Hz. The second tuned vent 10 may be tuned to a middle frequency or to a mid-frequency range, for example frequencies between 800 Hz and 4 kHz. The first tuned vent 8 and the second tuned vent 10 may be tuned to distinct or to overlapping frequency ranges.

By way of example only, a representative length for the first tuned vent 8 is 5 mm and a representative diameter for the first tuned vent 8 is 1 mm. The diameter to length ratio for the first tuned vent 8 in this example is, therefore, 1:5 and the cross-sectional area to length ratio for the first tuned vent 8 in this example is 79:500. Assuming a distal acoustic volume of approximately 1 $cm^3$, this results in a tuning frequency of approximately 650 Hz.

By way of example only, a representative length for the second tuned vent 10 is 2 mm and a representative diameter for the second tuned vent 10 is 1.5 mm. The diameter to length ratio for the second tuned vent 10 in this example is, therefore, 3:4 and the cross-sectional area to length ratio for the second tuned vent 10 in this example is 177:200.

Assuming a distal acoustic volume of approximately 1 $cm^3$, this results in a tuning frequency of approximately 1300 Hz.

The sound pressure level in the earphone body 2 may be enhanced or reduced by providing an amount of acoustic resistance for the first tuned vent 8 and/or the second tuned vent 10. In one embodiment, one or more forms of acoustic resistance are provided in series with the acoustic mass of the first tuned vent 8 and/or the second tuned vent 10. Acoustic resistance relates to the loss of energy of a sound wave and so providing an acoustic resistance means in series with the acoustic mass reduces the energy of a sound wave.

The acoustic resistance means may be in the form of a woven acoustic mesh. The acoustic resistance means may be placed over at least one opening of one or both of the tuned vents. Alternatively, or in addition the acoustic resistance means may be placed inside one or both of the tuned vents. By way of example, the woven mesh may be affixed by adhesive or friction or snap-fitted into place. It will be appreciated that other forms of acoustic resistance means may be used in addition or as an alternative. An acoustic resistance means has an associated resistance value which may be expressed in Rayleighs where 1 Rayleigh (1 Rayl) equals 1 pascal-second per meter.

By balancing factors such as acoustic resistance the frequency response for mid-range frequencies and low frequencies (e.g., bass frequencies) can be optimized optimised for the corresponding tuned vent.

Figure 3:
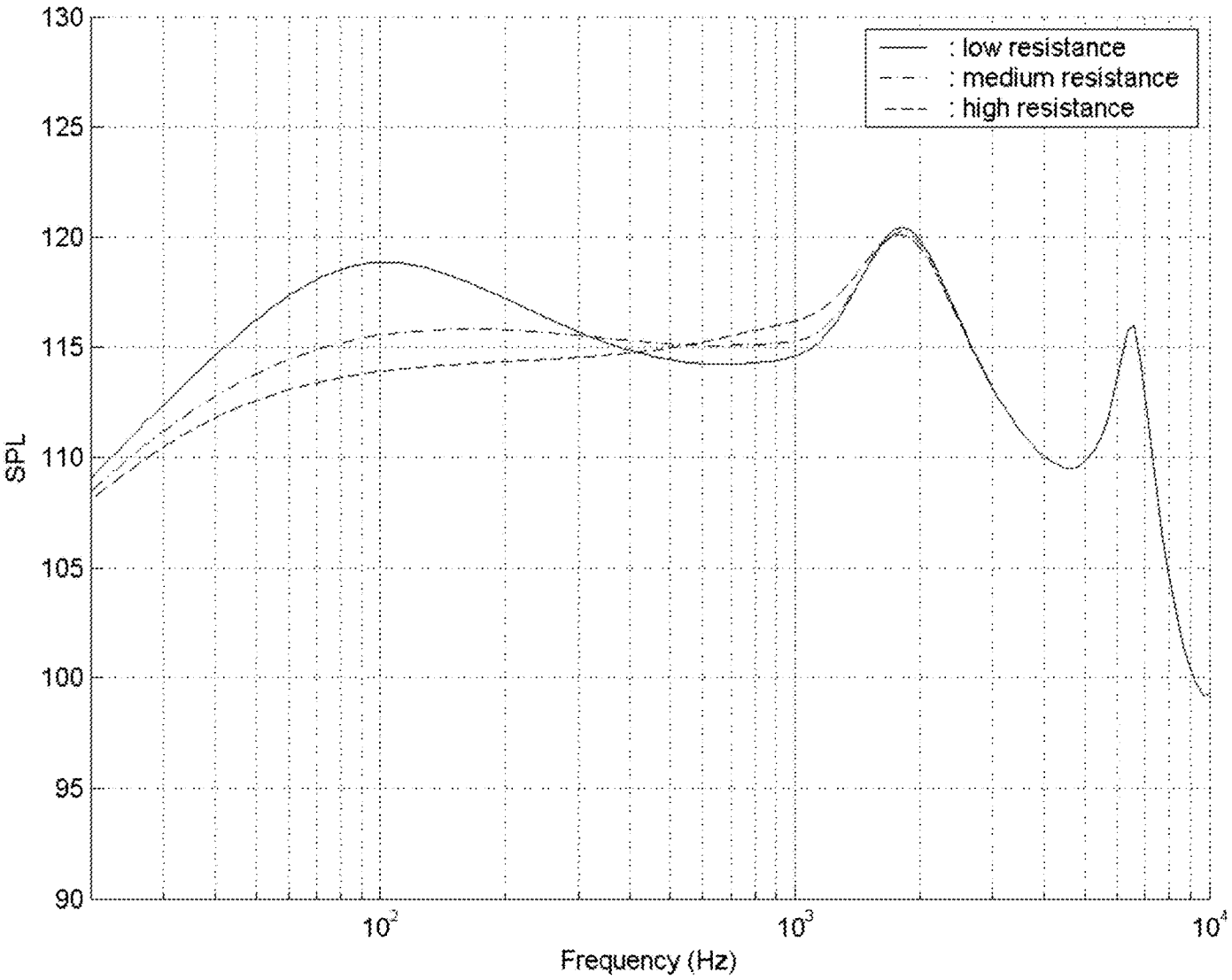
FIG. 3 is a graph of sound pressure level (SPL) (y axis) against frequency (Hertz) (x axis) for a tuned vent for low frequencies.
Figure 4:
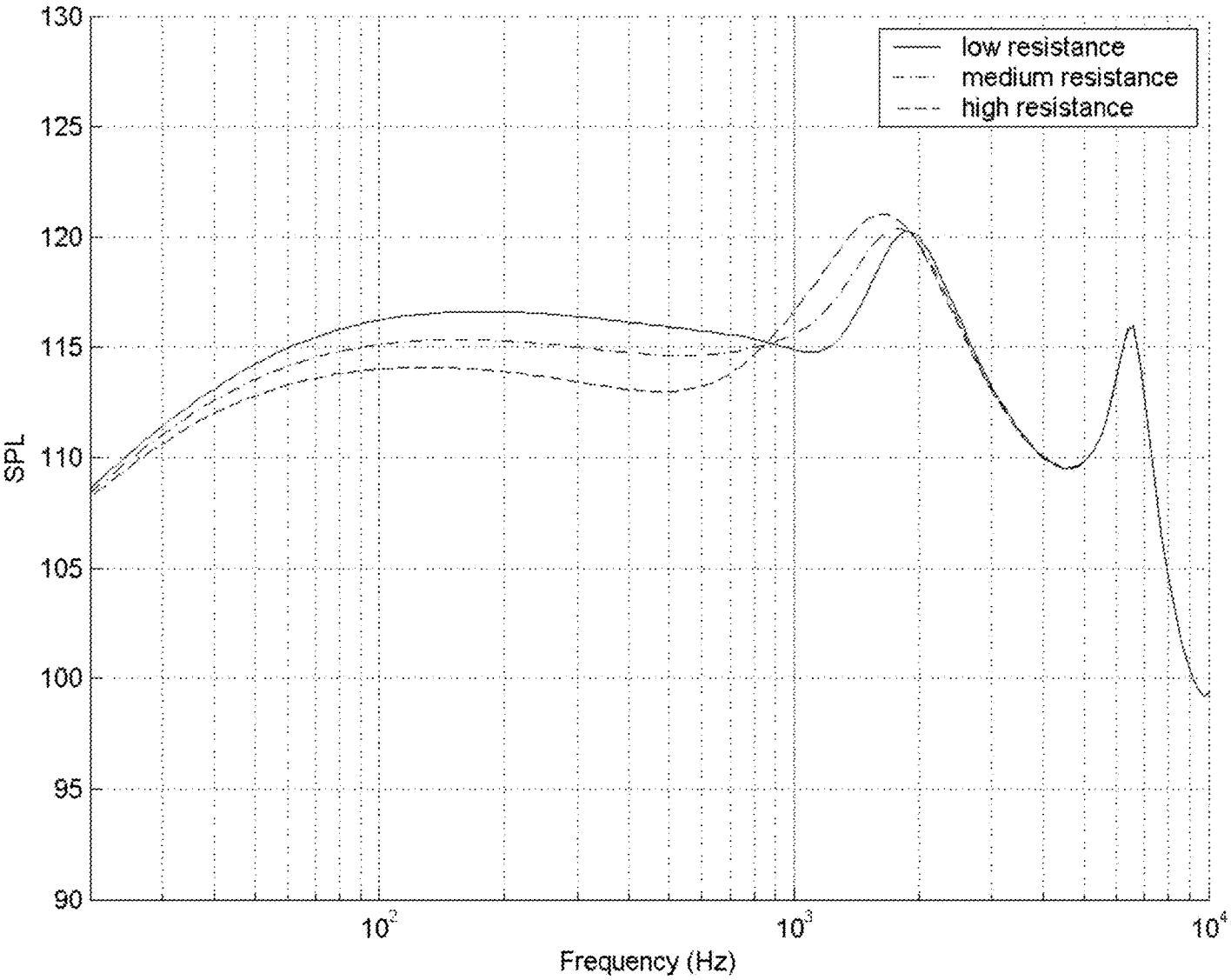
FIG. 4 is a graph of sound pressure level (SPL) (y axis) against frequency (Hertz) (x axis) for a tuned vent for mid-range frequencies.

FIGS. 3 and 4 are graphs of sound pressure level (SPL) against frequency (Hertz), with the graph of FIG. 3 relating to the effect of varying degrees of acoustic resistance on a first tuned vent 8, which is tuned to lower (low) frequencies, and FIG. 4 relating to the effect of varying degrees of acoustic resistance on a second tuned vent 10, which is tuned to higher (mid-range) frequencies.

The graphs of these figures have been prepared using a computer simulation. The dual vent system has also been measured on real samples, but the simulation allows for varying the acoustic resistance parameter with greater detail for better visual representation.

As shown in FIG. 3, an increase in the amount of acoustic resistance results in a decrease in sound pressure in the lower frequencies.

Conversely, with reference to FIG. 4, as the acoustic resistance is increased, there are greater sound pressure levels at higher frequencies, such that lower acoustic resistance may be preferable for the second tuned vent 10 to allow for amplification of the mid-range frequencies.

The earphone and the earphone body 2 of the present invention may include other components including but not limited to a battery, transceiver, Micro USB charge port, capacitor, Bluetooth® module, magnet and microphone. The internal components of the earphone and of the earphone body 2 may be arranged in any configuration which provides acceptable, preferably optimal, acoustic performance.

The tuned vents of the present invention are not holes or openings for microphones or sensors.

The invention has been described above with reference to a specific embodiment, given by way of example only. It will be appreciated that different configurations are possible, which fall within the scope of the appended claims.

The invention claimed is:

1. An earphone body comprising:

an internal chamber;

a transducer housed in the internal chamber, the transducer including a front surface facing in a direction of insertion of the earphone body in use and a rear surface;

a first tuned vent; and a second tuned vent, wherein the internal chamber provides a proximal acoustic volume adjacent the front surface of the transducer, wherein the internal chamber provides a distal acoustic volume adjacent the rear surface of the transducer, wherein a primary acoustic opening is located in a front section of the internal chamber of the earphone body for allowing sound to exit the proximal acoustic volume to a user's ear, wherein the first tuned vent and the second tuned vent each extend between the distal acoustic volume of the internal chamber and an ambient environment and are adapted to provide fluid communication between the distal acoustic volume and the ambient environment, the first tuned vent and the second tuned vent are located in a rear section of the internal chamber of the earphone body, and both the first tuned vent and the second tuned vent are located on the same side of the transducer, and wherein the first tuned vent is tuned to a first frequency or range of frequencies and the second tuned vent is tuned to a second frequency or range of frequencies, the first frequency or range of frequencies being lower than the second frequency or range of frequencies.

2. An earphone body as claimed in claim 1, wherein the first tuned vent has a lower cross-sectional area to length ratio than the second tuned vent.

3. An earphone body as claimed in claim 1, wherein the first tuned vent has at least one dimension which is different to a dimension of the second tuned vent, where the dimension is selected from the group consisting of width, diameter, length and cross-sectional area in a direction perpendicular to the length.

4. An earphone body as claimed in claim 3, wherein the first tuned vent and/or the second tuned vent is circular in cross-section in a direction perpendicular to the length of the tuned vent.

5. An earphone body as claimed in claim 1, wherein the first tuned vent and/or the second tuned vent has a tubular shape.

6. An earphone body as claimed in claim 5, wherein the first tuned vent and/or the second tuned vent has a tubular shape with at least one bent section along the length of the vent.

7. An earphone body as claimed in claim 1, wherein the first tuned vent and/or the second tuned vent is positioned to opposed the rear surface of the transducer.

8. An earphone body as claimed in claim 1, wherein the first tuned vent and/or the second tuned vent is provided with at least one acoustic resistance means.

9. An earphone body as claimed in claim 8, wherein the acoustic resistance means comprises a woven mesh.

10. An earphone comprising the earphone body of claim 1.

11. A method of adjusting sound pressure levels output from an earphone to a user's ear using the earphone body of claim 1, the method comprising:

sending an electrical signal to the transducer to produce sound waves in the proximal and distal acoustic volumes in the internal chamber of the earphone body;

outputting the sound waves to be received by a user's ear; and transmitting sound waves from the distal acoustic volume to the ambient environment through the first tuned vent and the second tuned vent.

* * * * *